US006609638B1

(12) United States Patent
Lott

(10) Patent No.: US 6,609,638 B1
(45) Date of Patent: Aug. 26, 2003

(54) FLOW PROMOTER FOR HOPPERS

(76) Inventor: W. Gerald Lott, 6950 Portwest Dr., Houston, TX (US) 77024

( * ) Notice: Subject to any disclaimer, the term of this patent is extended or adjusted under 35 U.S.C. 154(b) by 0 days.

(21) Appl. No.: 10/201,141

(22) Filed: Jul. 22, 2002

(51) Int. Cl.[7] ..... B67D 3/00
(52) U.S. Cl. ..... 222/564
(58) Field of Search ..... 222/547, 564

(56) References Cited

U.S. PATENT DOCUMENTS 4,129,233 A 12/1978 Schmader
4,138,020 A * 2/1979 Steiner et al. ..... 222/564
4,146,145 A 3/1979 Easton
4,399,931 A 8/1983 Maddalena
4,958,741 A 9/1990 Johanson
5,309,961 A * 5/1994 Franke et al. ..... 222/547
5,628,873 A 5/1997 Johanson et al.
5,960,990 A 10/1999 Radosevich
6,029,838 A 2/2000 Hansen e
6,085,949 A * 7/2000 Zimny et al. ..... 222/564
6,089,417 A 7/2000 Snekkenes
6,205,931 B1 3/2001 Degutis et al.

* cited by examiner

*Primary Examiner*—Philippe Derakshani
(74) *Attorney, Agent, or Firm*—Kenneth A. Keeling; James E. Hudson, III

(57) ABSTRACT

A flow promoter to promote flow of material in a hopper or bin container comprises a body having an inlet orifice, an outlet orifice, and an arrangement of peaks, ridges, slopes and radial lobes provided at the inlet end to cooperatively create stress points in the material. An embodiment of the invention comprises a removable flow promoter that can be inserted into a container.

20 Claims, 10 Drawing Sheets

– PRIOR ART –

FLOW PROMOTER FOR HOPPERS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of Invention

The invention is generally related to material hoppers and more specifically to hopper flow and discharge promoters.

2. Description of the Related Art

The prior art of the field of hopper flow and discharge promoters includes varied efforts to improve the process of unloading the contents of a hopper. Problems with the process of uniformly moving materials out of a hopper include arches, ratholes and other types of plugging.

Arches form when particles compact together and, being supported on a number of sides, become stable enough to support the weight of the material stored above. Arches interfere with or terminate material discharge from the bottom of hoppers. If and when they collapse, arches can result in a significant shift in material mass, causing an assortment of harms such as material supply surges, product flooding and equipment damage. Each particular material possesses a critical arching dimension, designated as $B_C$, which typifies a span over which that the material can arch in a circular conical hopper.

One method to prevent arching is to have the opening at the bottom of the hopper larger than the given material's critical arching dimension. However, processing applications typically require some degree of controlled feed into an aperture of reduced size, limiting the extent to which the opening at the bottom may be enlarged.

Ratholes are caused by uneven lateral pressure through a mass of particles. Walls of a bin that are not sufficiently steep provide lateral support to adjacent matter, allowing this material to cling to the sides. When an opening in the bottom of the bin allows flow, the material under lesser lateral pressure flows out first, creating a tunnel through the mass of material. Typically it is the material in the center of the bin, positioned over the bottom opening that consistently flows down the rathole through the rest of the material. A replenishing supply, typically from the top, refills the rathole. This recently added material then feeds out next, before the older material along the sides. Accordingly, the fresh material going down the rathole is used while the material along the sides of the hopper ages. Materials that lose their suitability after a period of time can deteriorate while stuck on the sides of the bin to the point of being unsuitable. When they finally come loose the quality of the resulting products will be unpredictable. If the material along the sides dislodges suddenly, it can constitute a substantial shift in mass, also causing a myriad of harms, to include material supply surges, product flooding and significant equipment damage.

The required angle of wall steepness to prevent material from clinging to the sides, referred to as the release angle, is dependent on the particular characteristics of the specific material to being handled, and is referred to as $\theta_C$. This release angel overcomes the cohesive strength of the material and the bin wall. In conical bins, this angle can be as high as 80 degrees. Since high angles require great heights to achieve useable capacities, low angle walls of 45 degrees or less are desired. Bins with 60-degree walls are used when materials have hang-up problems. Since users are constrained by their capacity requirements and their height limitations, called headroom, product flow problems frequently occur when materials possess a high $\theta_C$.

The quest for increased volume, minimal height and uninterrupted flow run contrary to each other. At a set wall angle, denoted as $\theta$, an increase in height increases volume. But volume is substantially reduced as the angle of the wall increases. The extra slope, rather that storage area, expends increased the height. This means that decreases in the wall angle, even minor ones, can make substantial increases in volume or decreases in required headroom for a specific volume.

Active and passive measures are employed to avoid flow problems. Active measures to induce smooth, complete material flow include vibratory, mechanical and matter-induced. These methods have been used individually or in combination.

Vibratory measures, as in U.S. Pat. No. 5,960,990 issued to Radosevich on Oct. 5, 1999, consist of inducing motion into the hopper structure in the attempt to prevent the material from forming stable structures. Vibration arrangements entail the initial cost of equipment and maintenance of equipment excessive wear by the vibratory process. Manual vibration is sometimes induced by hammering on the outside of the hopper.

Mechanical means primarily consist of paddles, as in U.S. Pat. No. 4,399,931 issued to Maddalena on Aug. 23, 1983, scrapers, as in U.S. Pat. No. 4,129,233 issued to Schmader on Dec. 12, 1978, or structures internal to the hopper, as in U.S. Pat. No. 5,960,990 issued to Radosevich on Oct. 5, 1999.

Matter-inducers, typically using air or some suitable fluid, introduce matter into the hopper with varied degrees of force. Aeration pads, as in U.S. Pat. No. 6,205,931 issued to Degutis et al on Mar. 27, 2001, positioned along the sides of the hopper add air to the material, fluidizing the layer along the side of the hopper, reducing the friction and promoting flow. Forceful air or fluid systems, as disclosed in U.S. Pat. No. 5,628,873 issued to Johanson et al on May 13, 1997, blast the material off the sides or over-pressure the entire hopper, jarring the material out of its stable position.

Passive measures include altering the design of the hopper and controlling the temperature and moisture content of the material. The primary passive measure used in the field is to contour the interior interface of the hopper so as to deny a support structure upon which the material can settle or adhere. The result is a variety of exotically shaped bins, with multiple vertical sections. A prominent example of such designs is U.S. Pat. No. 4,958,741 issued to Johanson on Sep. 25, 1990, which employs multiple structural sections of successively smaller diameter, possessing alternating round and oval openings. These methods have reduced material flow problems. Such units require wall slopes steep enough to cause flow at the hopper walls.

It would be an improvement to the art to provide for a hopper design that incorporates mass flow characteristics and arch breaking configurations in order to maximize capacity in a low-profile design.

The circumference of the outlet orifice is typically an impediment to flow from a hopper, as the outlet orifice is the most constrained point in a hopper. It would also therefore be an improvement to the art for a design to provide a mass flow arch breaking outlet configuration promoting terminal uniform first-in/first-out ("FIFO") flow of material from a hopper, as well as improving the ratio of hopper volume to outlet size.

BRIEF SUMMARY OF THE INVENTION

This invention is a flow promoter for use in material storage or process hoppers for either or both the main body of the hopper and the terminal outlet region of a hopper. The flow promoter can serve as the hopper or outlet housing, or be adapted as a lining component, inserted into existing devices.

This invention provides a flow promoter that induces flow of stored material over a relatively broad area in relation to outlet orifice area. Such induction is provided by a unique surface structure and a plurality of peaks and valleys at the inlet of the flow promoter, which surface, peaks and valleys cooperate to induce flow. Particularly, the flow promoter comprises a central cavity core with a plurality of tapered radial lobes. The flow promoter is generally tapered from the inlet end outer circumference toward the central cavity core and the outlet orifice. A plurality of peaks and valleys angularly spaced on the inlet end, between the radial lobes, create angular stress points, breaking up the uniform downward force pattern of the material, and diverting the material toward different sections of the flow promoter configuration.

Accordingly, the objects of my invention are to provide, inter alia, a hopper interface that:

- Promotes and supports mass flow in the contained material;
- Limits formation of ratholes and arches; and
- Provides containment and discharge of a large volume of material with minimal structural height.
- Decrease the required outlet orifice size with minimal structural height.

Other objects of my invention will become evident throughout the reading of this application.

DESCRIPTION OF THE INVENTION

Figure 1:
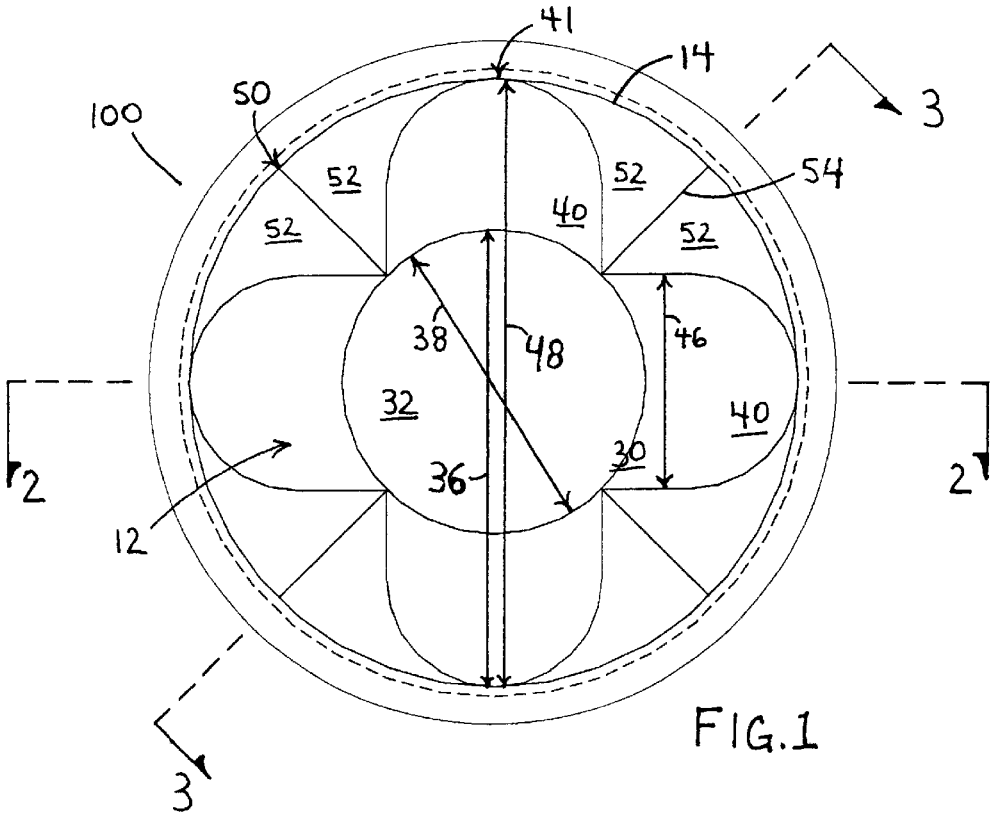
FIG. 1 is a top view of a flow promoter embodiment of the invention.

The current invention is a flow promoter 100, shown in FIGS. 1–4, which structurally promotes the flow of material contained in a hopper out a discharge outlet orifice 22. Flow promoter 100 can be embodied in the hopper, or as a component of the hopper flow system, such as a lower segment or an outlet aperture. The device can be constructed out of various materials that possess a surface of adhesion-reducing materials, such as polished stainless steel and ultra-high molecular weight plastic. Compatibility with the specific material handled should also be considered. The chosen construction material may affect the exterior dimensions and greater wall thickness may increase the actual operational body height 106.

The body 102 of the exemplary flow promoter 100, in FIGS. 1–4, is a single-segment apparatus with an inlet end 10 and an outlet end 20. In the exemplary embodiment, inlet end 10 has a circular outer edge 14, defining an inlet end perimeter. In the exemplary embodiment, a cavity 30 runs the length of body 102, from inlet end 10 to outlet end 20. Cavity 30 has a cylindrical cavity core 32, oriented along cavity core axis 34. Four (4) tapered radial lobes 40 are oriented perpendicular to cavity core axis 34. Cavity 30 at inlet end 10 defines an inlet orifice 12, through which material (not shown) can enter flow promoter 100. At outlet end 20, cavity 30 provides an outlet orifice 22, through which material can exit flow promoter 100.

Radial lobes 40 are spaced around the circumference of cavity core 30. The distances across the cavity core diameter 38 and out to the apogee 41 of a lobe 40 is the cavity lobe axis 36. Cavity lobe axes 36 are greatest at inlet end 10 of cavity 30. Lobes 40 intersect cavity core 32. In the exemplary embodiment, the major lobe axis 48 spans the entire width of cavity 30, from the lobe apogee 41 of one lobe 40 to the lobe apogee 41 of an opposing lobe 40.

Lobe cavity walls 42 slope from inlet end 10 to outlet end 20 at lobe cavity wall angles 44. Lobe cavity walls 42 have a steep slope at the top, near the intersection with inlet slopes 52, with a transition to a less steep slope at outlet orifice 22. The slope of lobe cavity wall 42 adjacent outlet orifice 22 is lobe cavity wall angle 44, measured from a line perpendicular cavity core axis 34.

At inlet end 10, between adjacent radial lobes 40, are inlet slopes 52 that ascend from lobes 40 to crest at inlet peaks 50. The slope of these inlet slopes 52 is referred to as slope angle 53, measured from a line perpendicular cavity core axis 34. Each inlet peak 50 accordingly has a pair of inlet slopes 52 sloping away from each other to adjacent lobes 40. In so doing, the two inlet slopes 52 form an inlet ridge 54 that slope from a respective inlet peak 50 to the edge of the cavity core 32 part of inlet orifice 12. Inlet peak 50 is proximate inlet outer edge 14, by inlet end 10. Inlet ridge 54 slopes downwardly from inlet peak 50 toward cavity core 32. The slope of this inlet ridge 54 is referred to as ridge angle 55, measured from a line perpendicular cavity core axis 34.

Figure 5:
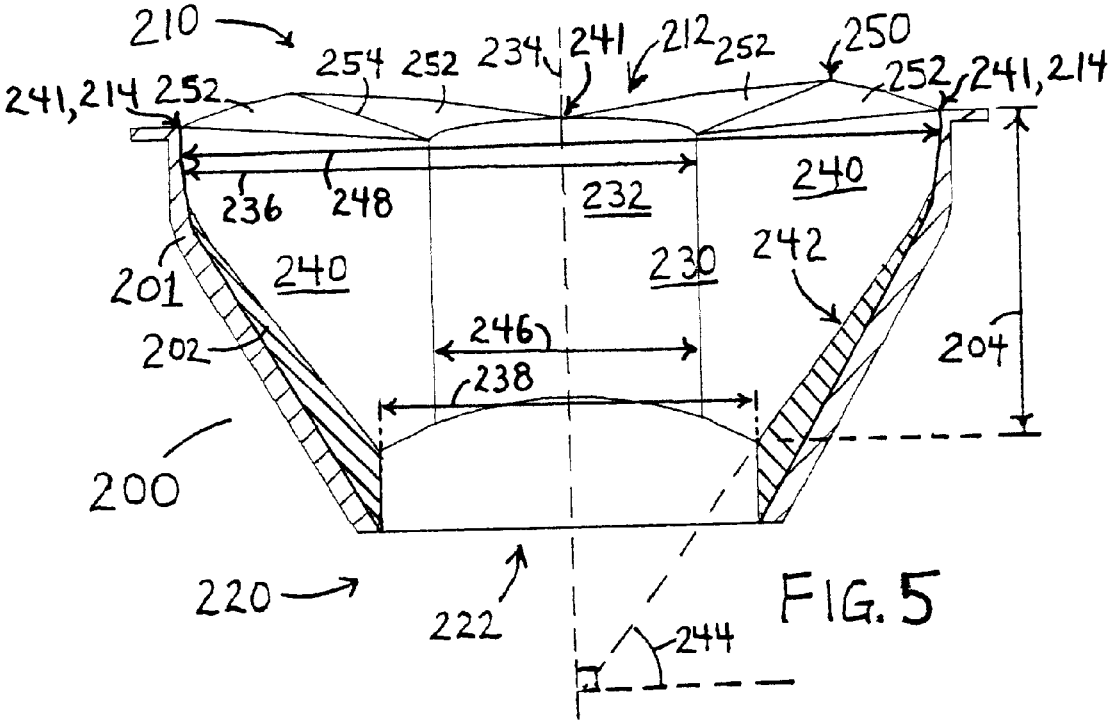
FIG. 5 is a cross-sectional side view of a liner embodiment of a flow promoter similar to that of FIG. 1, cut at line 2—2.
Figure 6:
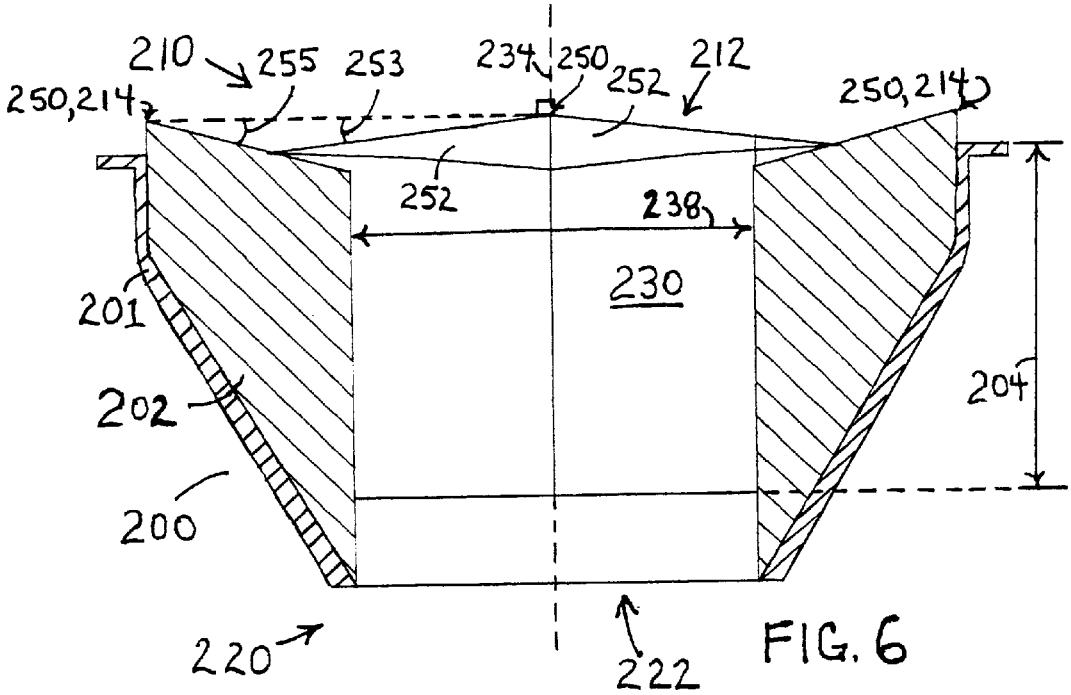
FIG. 6 is a cross-sectional side view of a liner embodiment of the flow promoter similar to that of FIG. 1, cut at line 3—3.
Figure 7:
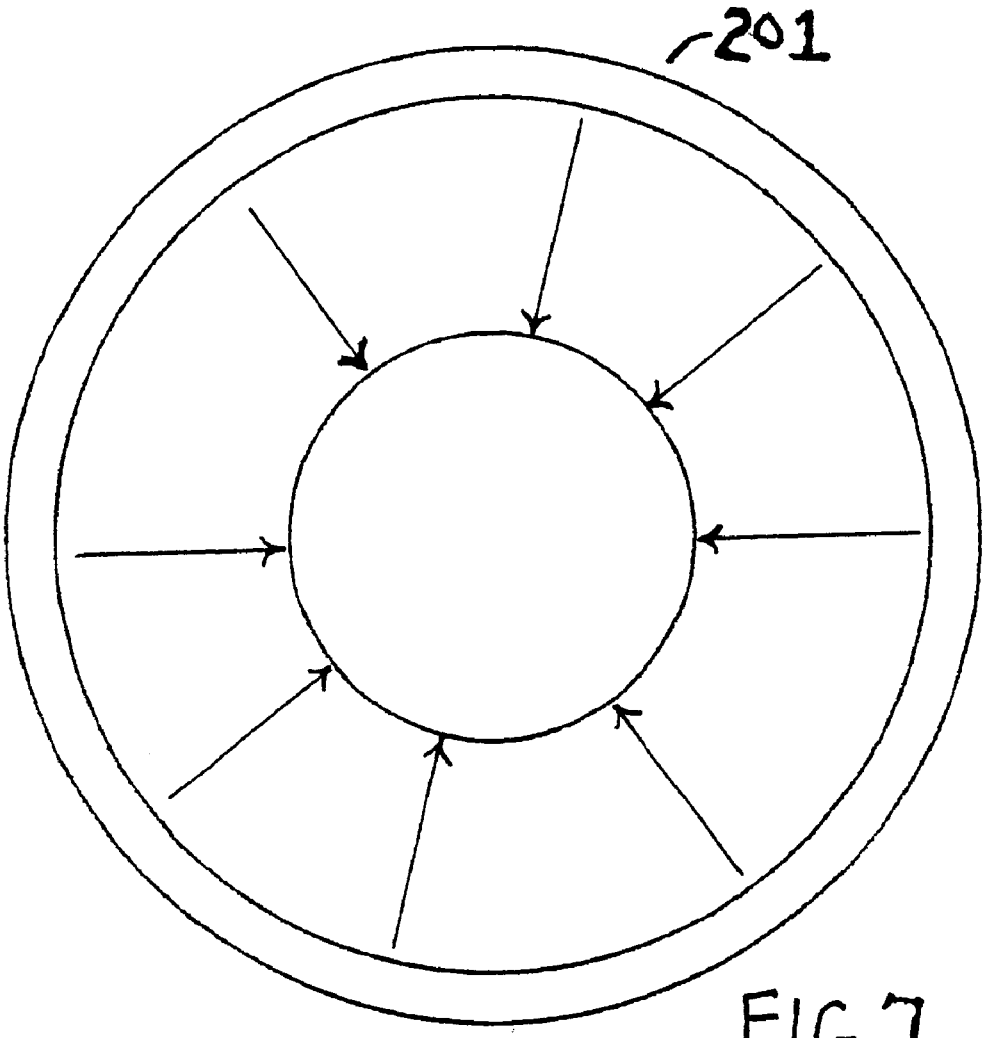
FIG. 7 is a top view of circumferential flow forces acting within a prior art circular flow device.

Referring to FIGS. 5, 6 and 7, flow-promoting liner 200 comprises an alternative embodiment of the present invention. Flow-promoting liner 200 has the same internal surface characteristics of flow promoter 100 discussed above. Similar reference numbers are used for flow-promoting liner 200 as corresponding elements in flow promoter 100. Liner body 202 may be inserted into standard shaped hoppers, such as a conical shaped concentric reducer 201, or into a receptacle sized to receive liner body 202. Concentric reducer 201 or other receiver provides rigid support to flow-promoting liner 200, permitting liner body 202 to be made of materials which more lightweight, less costly or meet other requirements. Liner body 202 may be wholly comprised of material with suitable friction and compatibility characteristics for the particular material to be handled, or the surface areas of cavity 230 can be lined with the suitable material.

Liner body 202 of the exemplary flow-promoting liner 200, in FIGS. 5 and 6, is a single-segment apparatus with an inlet end 210 and an outlet end 220, with inlet end 210 having a greater cross sectional area than outlet end 220. In the exemplary embodiment, a cavity 230 runs the length of body 202, from inlet end 210 to outlet end 220. Cavity 230 has a cylindrical cavity core 232, oriented along cavity core axis 234. Four (4) tapered radial lobes 240 are oriented perpendicular to cavity core axis 234. Cavity 230 at inlet end 210 defines an inlet orifice 212, through which material (not shown) can enter flow-promoting liner 200. At outlet end 220, cavity 230 provides an outlet orifice 222, through which material can exit flow-promoting liner 200.

Radial lobes 240 are spaced around the circumference of cavity core 230. The distances across the cavity core diameter 238 and out to the apogee 241 of a lobe 240 is the cavity lobe axis 236. Cavity lobe axes 236 are greatest at inlet end 210 of cavity 230. Lobes 240 intersect cavity core 232. In the exemplary embodiment, the major lobe axis 248 spans the entire width of cavity 230, from the lobe apogee 241 of one lobe 240 to the lobe apogee 241 of an opposing lobe 240.

Lobe cavity walls 242 slope from inlet end 210 to outlet end 220 at lobe cavity wall angles 244. Lobe cavity walls 242 have a steep slope at the top, near the intersection with inlet slopes 252, with a transition to a less steep slope at outlet orifice 222. The slope of lobe cavity wall 242 adjacent outlet orifice 222 is lobe cavity wall angle 244, measured from a line perpendicular cavity core axis 234.

At inlet end 210, between adjacent radial lobes 240, are inlet slopes 252 that ascend from lobes 240 to crest at inlet peaks 250. The slope of these inlet slopes 252 is referred to as slope angle 253, measured from a line perpendicular cavity core axis 234. Each inlet peak 250 accordingly has a pair of inlet slopes 252 sloping away from each other to adjacent lobes 240. In so doing, the two inlet slopes 252 form an inlet ridge 254 that slopes from a respective inlet peak 250 to the edge of the cavity core 232 part of inlet orifice 212. Inlet peak 250 is proximate inlet outer edge 214, by inlet end 210. Inlet ridge 254 slopes downwardly from inlet peak 250 toward cavity core 232. The slope of this inlet ridge 254 is referred to as inlet ridge angle 255, measured from a line perpendicular cavity core axis 234.

Referring to FIGS. 1–4, when placed into operation, flow promoter 100 is oriented with cavity core axis 34 substantially perpendicular to the ground. This puts inlet end 10 on the top and outlet end 20 on the bottom. More generally, to take into consideration other environments, cavity core axis 34 is oriented parallel with the directional force of resting material contained in flow promoter 100 apparatus.

Material enters cavity 30 through inlet orifice 12 on inlet end 10 of flow promoter 100. If the flow rate is light, the material immediately hits the surfaces of cavity 30 and continues down to outlet end 20 and out outlet orifice 22.

When the material entry rate is greater than the rate material is allowed to exit outlet orifice 22, either constrained by the capacity of outlet orifice 22 or an orifice closure (not shown), material amasses in cavity 30. This may be required by the storage system in order to regulate the bin's output rate with some type of conventional valve, for example, a butterfly valve. The particles of material (not shown) rest against each other, the lobe cavity walls 42, and the inlet peaks 50, inlet slopes 52 and inlet ridges 54. As particles of material at outlet orifice 22 exit cavity 30, material directly surrounding the exiting particles move into their place. The lobe cavity wall angles 44 are sufficiently steep and smooth to facilitate the movement of solid material along lobe cavity walls 42 to outlet orifice 22. The shape of cavity 30, with its non-circular radial lobes 40, does not provide sufficient support for the particles to form arches, which would stop the flow of material.

The required angle of steepness of lobe cavity walls 42 is affected by the required release angle, $\theta_C$, and critical arching diameter, $B_C$, of the specific material to be handled. The area of least slope along lobe cavity walls 42 only exist along a single line in each lobe 40, from lobe apogee 41 to outlet orifice 22, while the balance of lobe cavity walls 42 is steeper. So unlike a standard conical bin, the flow promoter 100 can be constructed with a lobe cavity wall angle 44 of less than $\theta_C$ and an outlet orifice 22 of less than $B_C$. The decrease in the lobe cavity wall angle 44 can be in the range of up to 20 degrees, and the decrease in the outlet orifice 22 can be more than 0.5 $B_C$, while still maintaining uniform first-in/first-out mass flow.

The inlet peaks 50, inlet slopes 52 and inlet ridges 54 create the effect of having additional height for sloped lobe cavity walls 42, because the inlet peaks 50, inlet slopes 52 and inlet ridges 54 extend above inlet orifice 12, into the preceding component of the storage/feed system (not shown), reducing the actual required headroom.

Greater lobe cavity wall angles 44 and inlet peaks 50, inlet slopes 52 and inlet ridges 54 provide a greater aspect ratio of inlet orifice 12 diameter to cavity height 104. A relatively large aspect ratio indicates the total volume of the flow promoter 100 is increased for the particular body height 106, minimizing the device's required headroom. In a 45 degree conical bin the aspect ratio is 1, so an increase in diameter results in a corresponding direct increase in height. The variable pitch of lobe cavity walls 42 provides less lateral support to the material, allowing uninterrupted flow from less steep slopes than achievable with a conical shape.

Greater lobe cavity wall angles 44 and inlet peaks 50, inlet slopes 52 and inlet ridges 54 also provide a greater ratio of inlet orifice 12 diameter to outlet orifice 22 diameter. A larger inlet-to-outlet diameter ratio means that the total diameter of the outlet orifice 22 is reduced more over an allowable cavity height 104, making the device a concentric reducer. In a 45-degree conical bin the inlet-to-outlet diameter ratio is 1 to 1, but materials with a $\theta_C$ of greater than 45 degrees will cling to the conical walls and stoppages, ratholes and arching can occur. The variable pitch of lobe cavity walls 42 provides less lateral support to the material, allowing uninterrupted flow from less steep slope than achievable with a conical shape. Therefore, the device can possess a lobe cavity wall angle 44 of 10 to 20 degrees less than $\theta_C$ and an outlet aperture diameter less than 0.5 $B_C$, and still maintain uniform first-in/first-out mass flow.

When flow promoter 100 is used in conjunction with a material supply system that provides a supply of material spanning the entire inlet end 10, inlet peaks 50, inlet slopes 52 and inlet ridges 54 operate to break the cohesion between particles of material and divert the flow to inlet orifice 12. By protruding up into the incoming flow of material, inlet peaks 50, inlet slopes 52 and inlet ridges 54 are able to interface with the flow of material with a steeper angle than can be achieved by recesses alone over the same cross sectional area.

Figure 1A:
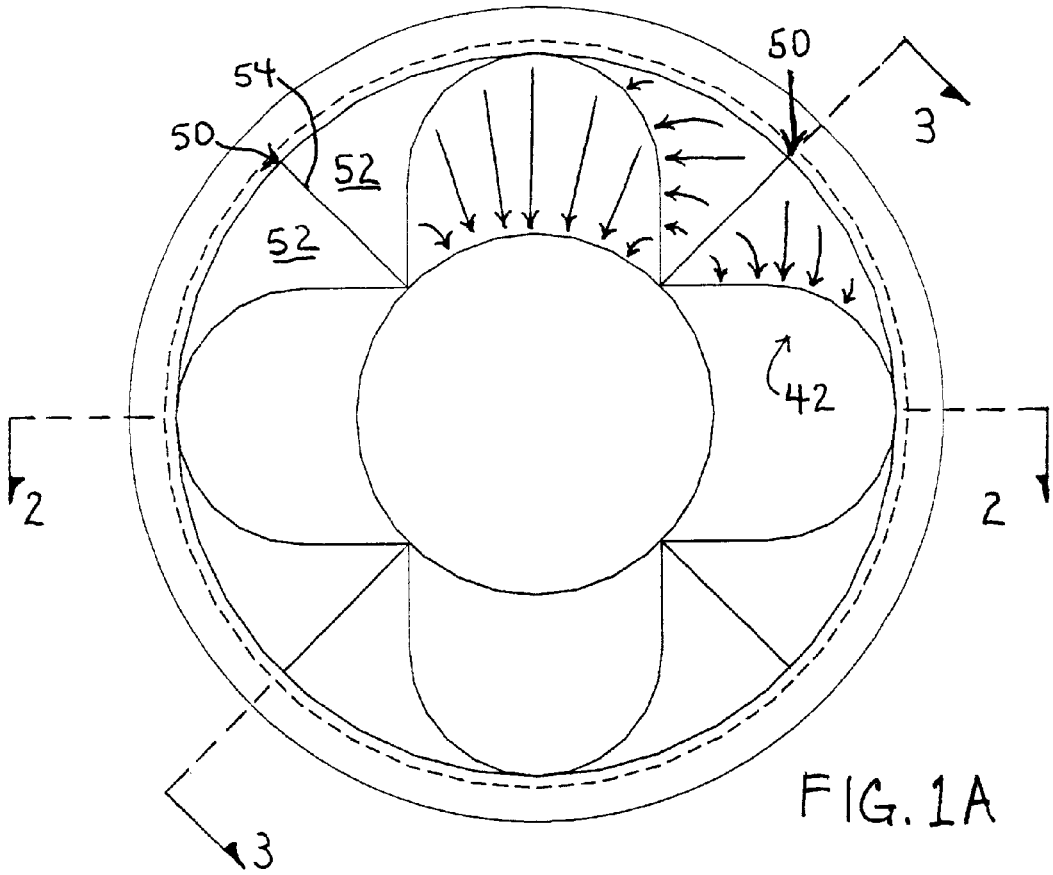
FIG. 1A is a top view of circumferential flow forces acting within the flow promoter of FIG. 1.
Figure 2:
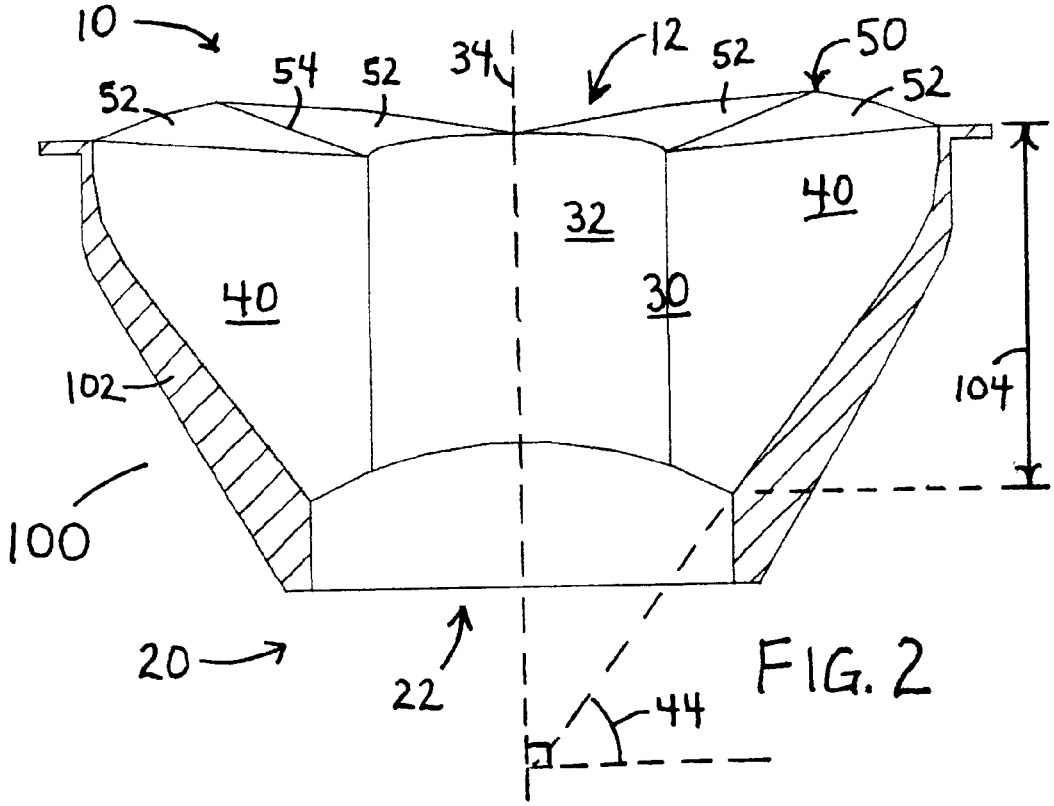
FIG. 2 is a cross-sectional side view of the flow promoter of FIG. 1, cut at line 2—2.
Figure 2A:
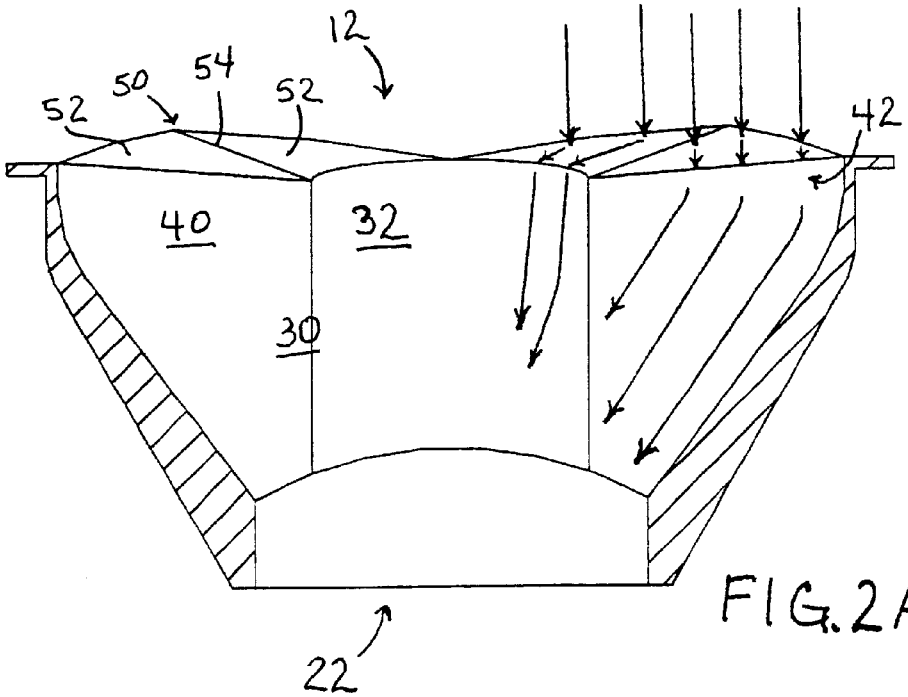
FIG. 2A is a cross-sectional side view of the flow forces acting within the flow promoter of FIG. 1, cut at line 2—2.
Figure 3:
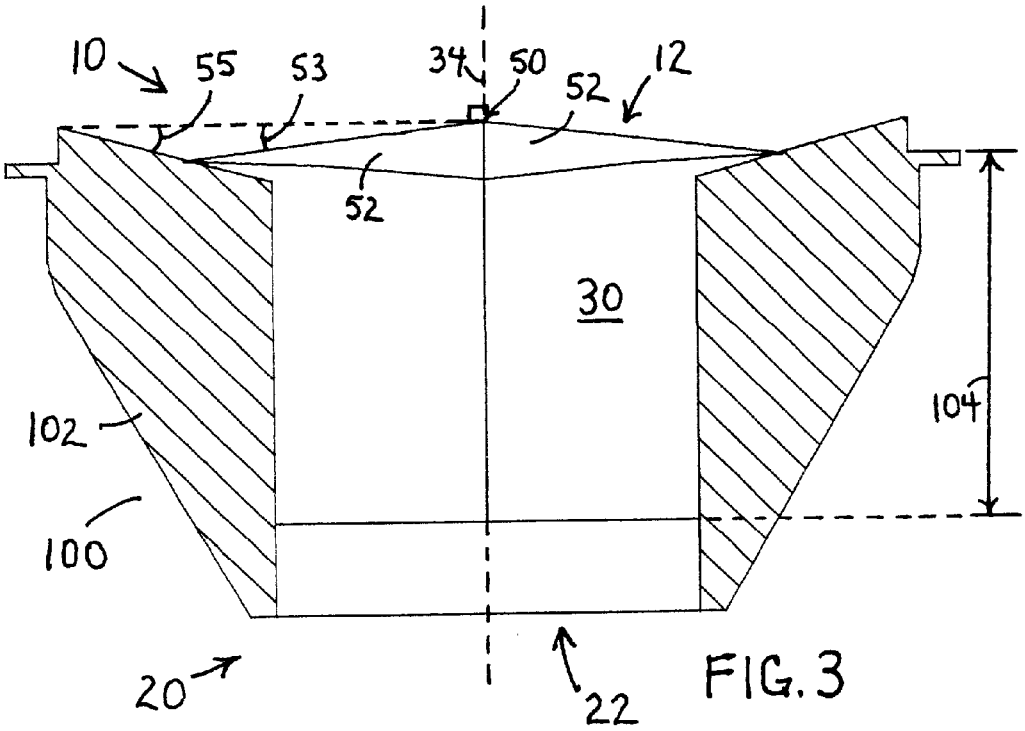
FIG. 3 is a cross-sectional side view of the flow promoter of FIG. 1, cut at line 3—3.
Figure 3A:
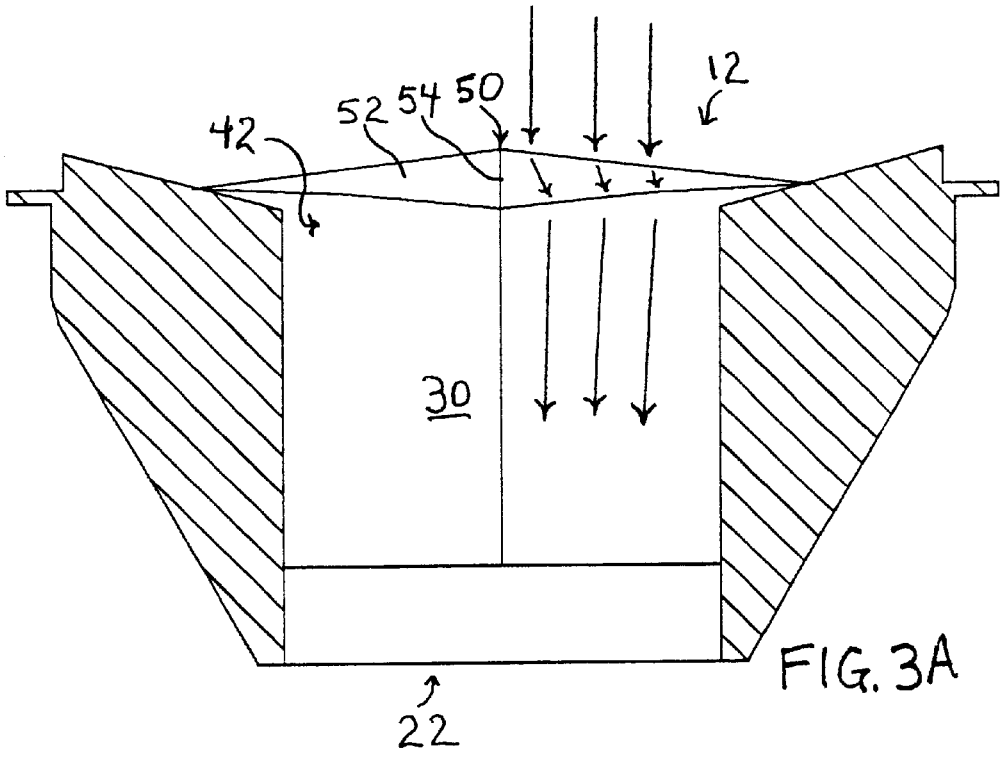
FIG. 3A is a cross-sectional side view of the flow forces acting within the flow promoter of FIG. 1, cut at line 3—3.
Figure 4:
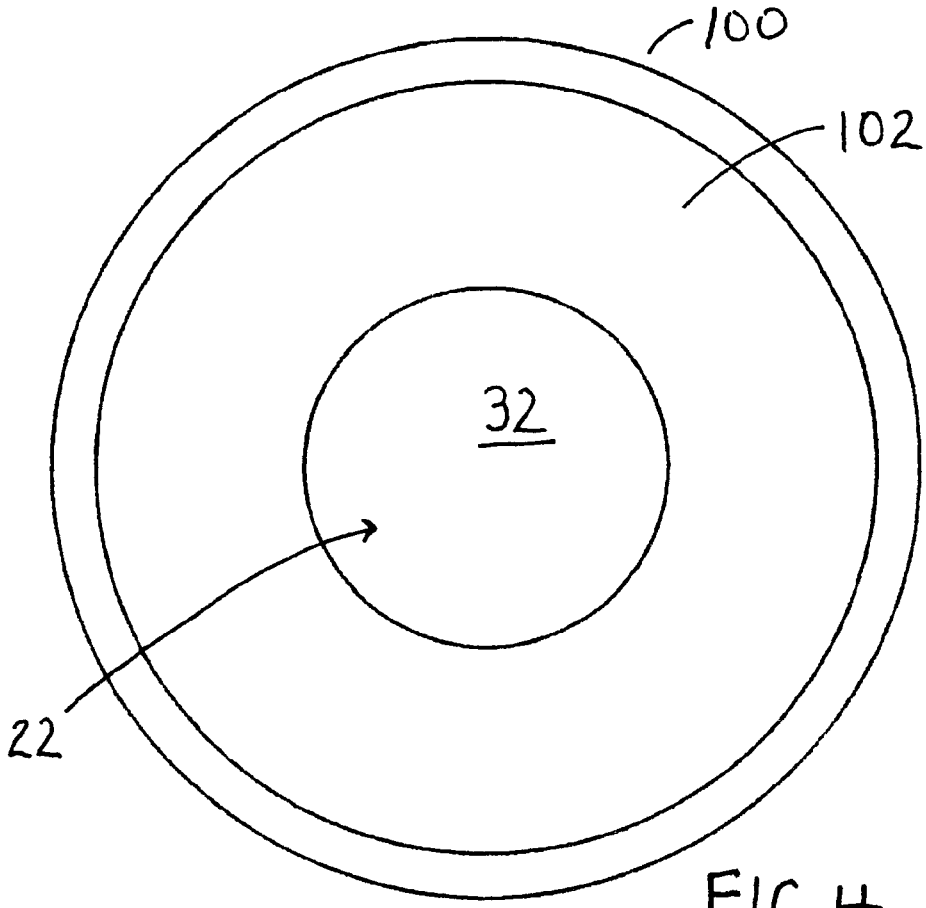
FIG. 4 is a bottom view of a flow promoter embodiment of the invention.

Referring to FIG. 7, in the prior art conical shaped concentric reducer 201 every point around the circumference can mutually support the stress from the load of the material. Referring to Fig. 1A, 2A and 3A, the various slopes of inlet slopes 52 and lobe cavity walls 42 do not allow the particles of material to become fixed in a stationary position, but instead provide stress points.

The material approaches inlet orifice 12 at an angle generally parallel with cavity core axis 34. The particles that strike inlet peaks 50, inlet slopes 52 and inlet ridges 54 are deflected at varied angles, on either side of inlet ridges 54, along the length of inlet slopes 52. In the exemplary embodiment, incline surfaces angles 53 range from 5 to 15 degrees, meaning the incoming material is deflected at 75 to 85 degrees. The exemplary inlet ridges 54 are the area of steepest pitch. The pitches of inlet slopes 52 gradually taper between inlet peaks 50 and lobe apogees 41. As the material reaches the interface of inlet slopes 52 and lobes 40, the direction of the force shifts downward. Depending on where the material is along the edge of lobes 40, the downward angle of force may range from lobe cavity wall angle 44 to 90 degrees. Referring to FIG. 2 and 2A, the exemplary embodiment has a short, sheer 90-degree drop along the top of lobe cavity wall 42, adjacent to inlet slopes 52. The downward forces follow lobe cavity wall 42 on an inward slope, which varies from 90 degrees at the cavity core 32 to lobe cavity wall angle 44 along cavity lobe axis 36.

The material moving through flow promoter 100 is pushed inward by forces as well as downward. Referring to Fig. 1A, the non-circular cross-section of cavity 30 results in non-uniform lateral forces on all the material particles, thereby promoting flow of powders, such as cement, clay (bentonite, kaolin or the like), barium sulfite (also known as barite), and other materials, such as granules and crystals.

The flow promoting properties of the device make it suitable for retrofit into bin storage feed systems, which are experiencing flow output problems. There is no conflict in combining the device in prior art configurations. The properties also make the system suitable for open feed configurations, such as a hopper, bagger, or linkage to a constrained feed mechanism, such as an eductor, conveyor or rotary valve.

The foregoing description of operation of flow promoter 100 applies to alternative embodiment flow-promoting liner 200. A particular advantage of flow-promoting liner 200 is that flow-promoting liner 200 may be inserted in a cavity or existing outlet and may be removed and replaced for maintenance or if a different surface geometries or material compatibilities are required.

Flow promoters 100 and flow-promoting liner 200 are depicted with four lobes 40. The teachings of the present invention may be applied utilizing a greater or lesser number of lobes 40.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A material flow promoter comprising:

a flow promoter body having a cavity core, an inlet end, an outlet end and a central axis;

said cavity core extending from said inlet end through said flow promoter body to said outlet end;

said cavity core defining an outlet orifice at said outlet end;

said inlet end comprising an inlet orifice and an inlet face;

said cavity core and a plurality of lobes defining said inlet orifice; and said inlet face comprising a plurality of inlet ridges and a plurality of inlet slopes.

2. The flow promoter of claim 1 wherein:

each of said inlet ridges intermediate two of said plurality of lobes; and each of said inlet slopes intermediate one of said plurality of inlet ridges and one of said plurality of lobes.

3. The flow promoter of claim 1 wherein:

said inlet face further comprising a plurality of inlet peaks;

said inlet face having an inlet outer edge; and each said inlet peaks proximate said inlet outer edge.

4. The flow promoter of claim 3 wherein:

each of said inlet ridges extending from one of said plurality of inlet peaks to said cavity core; and each of said inlet ridges having a ridge incline from one of said plurality of inlet peaks to said cavity core.

5. The flow promoter of claim 2 wherein:

said inlet end disposed above said outlet end;

each of said ridge inclines sloping downwardly from one of said inlet peaks to said inlet orifice; and each of said inlet slopes sloping downwardly from one of said plurality of inlet ridges to one of said plurality of lobes.

6. The flow promoter of claim 1 wherein:

each said inlet ridges defining a ridge angle from perpendicular of said central axis; and each said ridge angle in the range of 5 degrees to 10 degrees.

7. The flow promoter of claim 1 wherein:

each said inlet slope defining a slope angle from perpendicular of said central axis; and each said slope angle in the range of 10 degrees to 20 degrees.

8. The flow promoter of claim 1 further comprising:

a cavity wall intermediate said inlet orifice and said outlet orifice;

said cavity wall comprising a plurality of lobe cavity walls; and said lobe cavity walls sloped from a lobe apogee to said outlet orifice.

9. The flow promoter of claim 8 wherein:

each said lobe cavity walls defining lobe cavity wall slopes;

said lobe cavity wall slopes defining a plurality of lobe cavity wall angles in relation to said central axis; and each said lobe cavity wall angles in the range of between 45 degrees to said central axis and parallel to said central axis.

10. The flow promoter of claim 1 wherein:

said flow promoter comprising a flow promoter liner for removeable insertion in a liner retainer.

11. The flow promoter of claim 10 wherein:

said liner retainer comprising a concentric reducer.

12. The flow promoter of claim 1 wherein:

said inlet orifice larger than said outlet orifice.

13. A material flow promoter comprising:

a flow promoter body having a cavity core, an inlet end, an outlet end and a central axis;

said cavity core extending from said inlet end through said flow promoter body to said outlet end;

said cavity core defining an outlet orifice at said outlet end;

said inlet end comprising an inlet orifice and an inlet face;

said cavity core and a plurality of lobes defining said inlet orifice;

said inlet face comprising a plurality of inlet ridges, a plurality of inlet slopes and a plurality of inlet peaks;

each of said inlet ridges intermediate two of said plurality of lobes;

each of said inlet slopes intermediate one of said plurality of inlet ridges and one of said plurality of lobes;

said inlet face having an inlet outer edge;

each said inlet peaks proximate said inlet outer edge;

each of said inlet ridges extending from one of said plurality of inlet peaks to said cavity core; and each of said inlet ridges having a ridge incline from one of said plurality of inlet peaks to said cavity core.

14. The flow promoter of claim 13 wherein:

said inlet end disposed above said outlet end;

each of said ridge inclines sloping downwardly from one of said inlet peaks to said inlet orifice; and each of said inlet slopes sloping downwardly from one of said plurality of inlet ridges to one of said plurality of lobes.

15. The flow promoter of claim 14 wherein:

each said inlet ridges defining a ridge angle from perpendicular of said central axis;

each said ridge angle in the range of 5 degrees to 10 degrees;

each said inlet slope defining a slope angle from perpendicular of said central axis; and each said slope angle in the range of 10 degrees to 20 degrees.

16. The flow promoter of claim 14 further comprising:

a cavity wall intermediate said inlet orifice and said outlet orifice;

said cavity wall comprising a plurality of lobe cavity walls; and said lobe cavity walls sloped from a lobe apogee to said outlet orifice.

17. The flow promoter of claim 14 wherein:

each said lobe cavity walls defining lobe cavity wall slopes;

said lobe cavity wall slopes defining a plurality of lobe cavity wall angles in relation to said central axis; and each said lobe cavity wall angles in the range of between 45 degrees to said central axis and parallel to said central axis.

18. The flow promoter of claim 14 wherein:

said flow promoter comprising a flow promoter liner for removeable insertion in a liner retainer.

19. A material flow promoter comprising:

a flow promoter body having a cavity core, an inlet end, an outlet end and a central axis;

said cavity core extending from said inlet end through said flow promoter body to said outlet end;

said cavity core defining an outlet orifice at said outlet end;

said inlet end comprising an inlet orifice and an inlet face;

said cavity core and a plurality of lobes defining said inlet orifice;

said inlet face comprising a plurality of inlet ridges, a plurality of inlet slopes and a plurality of inlet peaks;

each of said inlet ridges intermediate two of said plurality of lobes;

each of said inlet slopes intermediate one of said plurality of inlet ridges and one of said plurality of lobes;

said inlet face having an inlet outer edge;

each said inlet peaks proximate said inlet outer edge;

each of said inlet ridges extending from one of said plurality of inlet peaks to said cavity core; and each of said inlet ridges having a ridge incline from one of said plurality of inlet peaks to said cavity core;

each of said ridge inclines sloping from one of said inlet peaks to said inlet orifice;

each of said inlet slopes sloping from one of said plurality of inlet ridges to one of said plurality of lobes;

a cavity wall intermediate said inlet orifice and said outlet orifice;

said cavity wall comprising a plurality of lobe cavity walls;

said lobe cavity walls sloped from a lobe apogee to said outlet orifice; each said lobe cavity walls defining lobe cavity wall slopes; and said lobe cavity wall slopes defining a plurality of lobe cavity wall angles in relation to said central axis.

20. The flow promoter of claim 19 wherein:

said flow promoter comprising a flow promoter liner for removeable insertion in a liner retainer.

* * * * *